US006688922B2

(12) United States Patent
Schreier et al.

(10) Patent No.: US 6,688,922 B2
(45) Date of Patent: Feb. 10, 2004

(54) PLUG CONNECTOR

(75) Inventors: Stephan Schreier, Rahden (DE); Hartmut Schwettmann, Rahden (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/849,836

(22) Filed: May 4, 2001

(65) Prior Publication Data

US 2001/0039148 A1 Nov. 8, 2001

(51) Int. Cl.[7] ..... H01R 13/05
(52) U.S. Cl. ..... 439/825; 439/606
(58) Field of Search ..... 439/829, 105, 439/598, 638, 651, 825, 606, 686, 281, 589

(56) References Cited

U.S. PATENT DOCUMENTS

| | | | | | |
|---|---|---|---|---|---|
| 5,197,908 | A | * | 3/1993 | Nelson | 439/825 |
| 5,338,211 | A | * | 8/1994 | Kodama et al. | 439/135 |
| 5,387,116 | A | * | 2/1995 | Wang | 439/188 |
| 5,387,119 | A | * | 2/1995 | Wood | 439/281 |
| 5,470,239 | A | * | 11/1995 | Rancourt | 439/105 |
| 5,890,930 | A | * | 4/1999 | Grow | 439/651 |
| 5,984,724 | A | * | 11/1999 | McNeel | 439/606 |
| 6,145,193 | A | * | 11/2000 | Gauker | 29/882 |
| 6,322,398 | B1 | * | 11/2001 | Fladung | 439/686 |

FOREIGN PATENT DOCUMENTS

| | | |
|---|---|---|
| JP | 63-8067 | 3/1988 |
| JP | 3-199974 | 8/1991 |
| JP | 3-291874 | 12/1991 |
| JP | 6-052950 | 2/1994 |
| JP | 6-62475 | 9/1994 |
| JP | 11-176517 | 7/1999 |

* cited by examiner

*Primary Examiner*—Alexander Gilman
(74) *Attorney, Agent, or Firm*—Cook, Alex, McFarron, Manzo, Cummings & Mehler, Ltd.

(57) ABSTRACT

A plug connector comprises a first insulating body, at least one connection contact which is arranged in the first insulating body and is provided for being connected with a conductor, a second insulating body and at least one plug-in contact which is arranged in the second insulating body and is provided for being connected with a complementary plug connector. The plug-in contact and the connection contact are connected with each other in an electrically conductive manner by a plug connection. The plug connection is formed by two elastic tabs provided on one of the contacts and cooperating with the other of the contacts. A method for mounting a plug connector comprises the following steps: First, at least one connection contact is arranged in a first insulating body. Then, at least one plug-in contact is arranged in a second insulating body. Finally, the plug-in contact and the connection contact are inserted into each other.

10 Claims, 11 Drawing Sheets

PLUG CONNECTOR

The invention relates to a plug connector and a method for mounting a plug connector.

BACKGROUND OF THE INVENTION

Conventional plug connectors typically comprise at least one plug-in contact provided for being connected with a complementary plug connector, and comprising at least one connection contact provided for being connected with a conductor.

In such a plug connector, the plug-in contact is usually soldered with the connection contact during mounting. This does ensure a reliable electrical connection between the two contacts, but production costs are increased thereby. Plug connectors are also known, in which the plug-in contact or the connection contact is provided with a jack and the other contact part is provided with a pin which can be inserted into the jack. This, however, makes possible a plug connection only if a socket is used as plug-in contact.

The object of the invention is to further develop a plug connector and a method for its mounting such that low production costs arise whilst at the same time maintaining a reliable electrical connection between the two contacts. Furthermore, the plug connector is intended to allow a modular concept, so that a wide field of application can be covered with few components.

BRIEF DESCRIPTION OF THE INVENTION

The invention provides a plug connector comprising a first insulating body, at least one connection contact which is arranged in the first insulating body and is provided for being connected with a conductor, a second insulating body and at least one plug-in contact which is arranged in the second insulating body and is provided for being connected with a complementary plug connector. The plug-in contact and the connection contact are connected with each other in an electrically conductive manner by a plug connection. The plug connection is formed by two elastic tabs provided on one of the contacts and cooperating with the other of the contacts. Due to their elasticity, the two elastic tabs allow to maintain a desired contact force between the plug-in contact and the connection contact over long periods of time. This contact force is higher than with the use of socket and pin, as there appears a linear or even punctiform contact, instead of an areal contact as it occurs in prior art. The plug-in tab may be formed with particularly low expenditure, if the corresponding contact is a flat contact which, for instance, is stamped from a sheet metal, for instance a piercing contact which serves as connection contact for a cable to be connected with the plug connector.

A particularly high flexibility during manufacture results from the use of the plug connection between the connection contact and the plug-in contact. Depending on the desired embodiment of the plug connector, the two contacts can be inserted into each other in longitudinal direction or also at a right angle to each other.

It is preferably provided for that the insulating body is provided with at least one guiding pin which ensures the correct alignment of the insulating body, so that a defined polarization of connection and plug-in contacts relative to each other is reliably maintained.

According to a preferred embodiment of the invention it is provided for that one of the insulating bodies is the housing of the plug connector and the other insulating body is an insert piece which is received in the housing. A particularly low-cost production results from this design, because the two insulating bodies have only to be equipped with the corresponding contacts and finally the one insulating body has to be inserted into the other; a latching connection may be used for fixing the insulating body in the housing. On pushing in of the insulating body, the plug-in and the connection contacts are inserted into each other without further steps being necessary. This type of mounting was not possible hitherto, because the connection and the plug-in contacts had to be soldered to each other during mounting.

According to an alternative preferred embodiment of the invention it is provided for that the two insulating bodies are arranged in a separate housing. In this embodiment, too, a particularly low-cost mounting is possible; the two insulating bodies have only to be pushed into the housing, a latching connection being optionally provided by means of which the insulating bodies latch in place in the housing. Upon pushing in the insulating bodies, the connection and the plug-in contacts are automatically inserted into each other, so that the electrically conductive connection is produced between them.

According to a further preferred embodiment the two insulating bodies are embedded by injection molding, so that a housing is formed. In this way the two insulating bodies can be inseparably connected to each other and to the housing; at the same time there is a large freedom with respect to the design of the housing.

Preferably an adapter is provided into which the plug-in contact and the connection contact are inserted. This adapter acts in the nature of a mounting support, in which the plug-in and the connection contacts are reliably received, prior to embedding the insulating bodies and the contacts received therein by injection molding. Due to the contacts being held in the adapter, the preassembled unit, which consists of the two insulating bodies inserted in the adapter with their contacts, can be reliably handled during mounting, without facing the danger that the connection and plug-in contacts, which are inserted into each other, detach from each other.

Advantageous embodiments of the invention will be apparent from the sub-claims.

The invention will now be described with the aid of various embodiments illustrated in the appended drawings in which.

Figure 1:
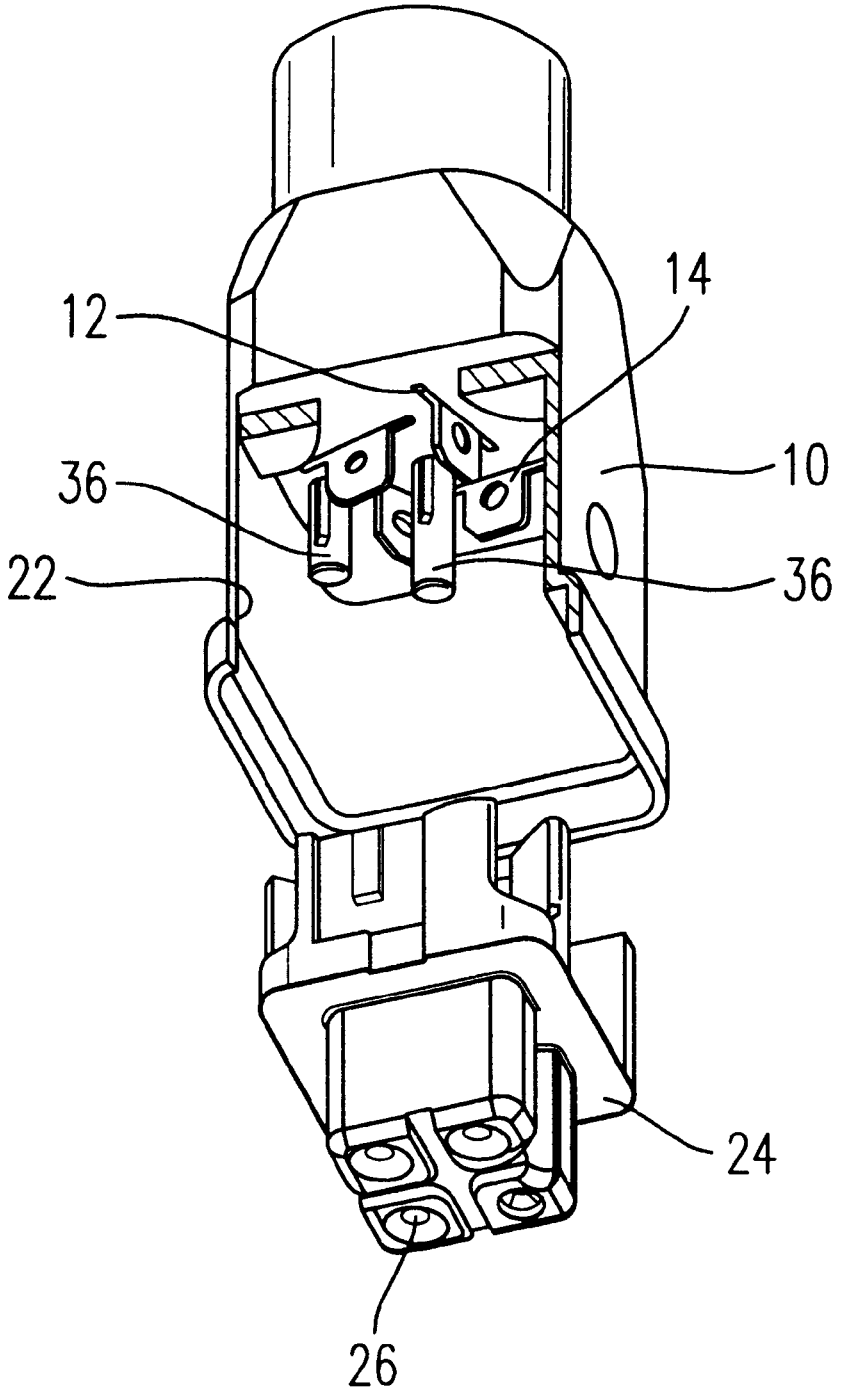
FIG. 1 shows a plug connector according to a first embodiment of the invention during mounting in a perspective, partially sectioned view.
Figure 2:
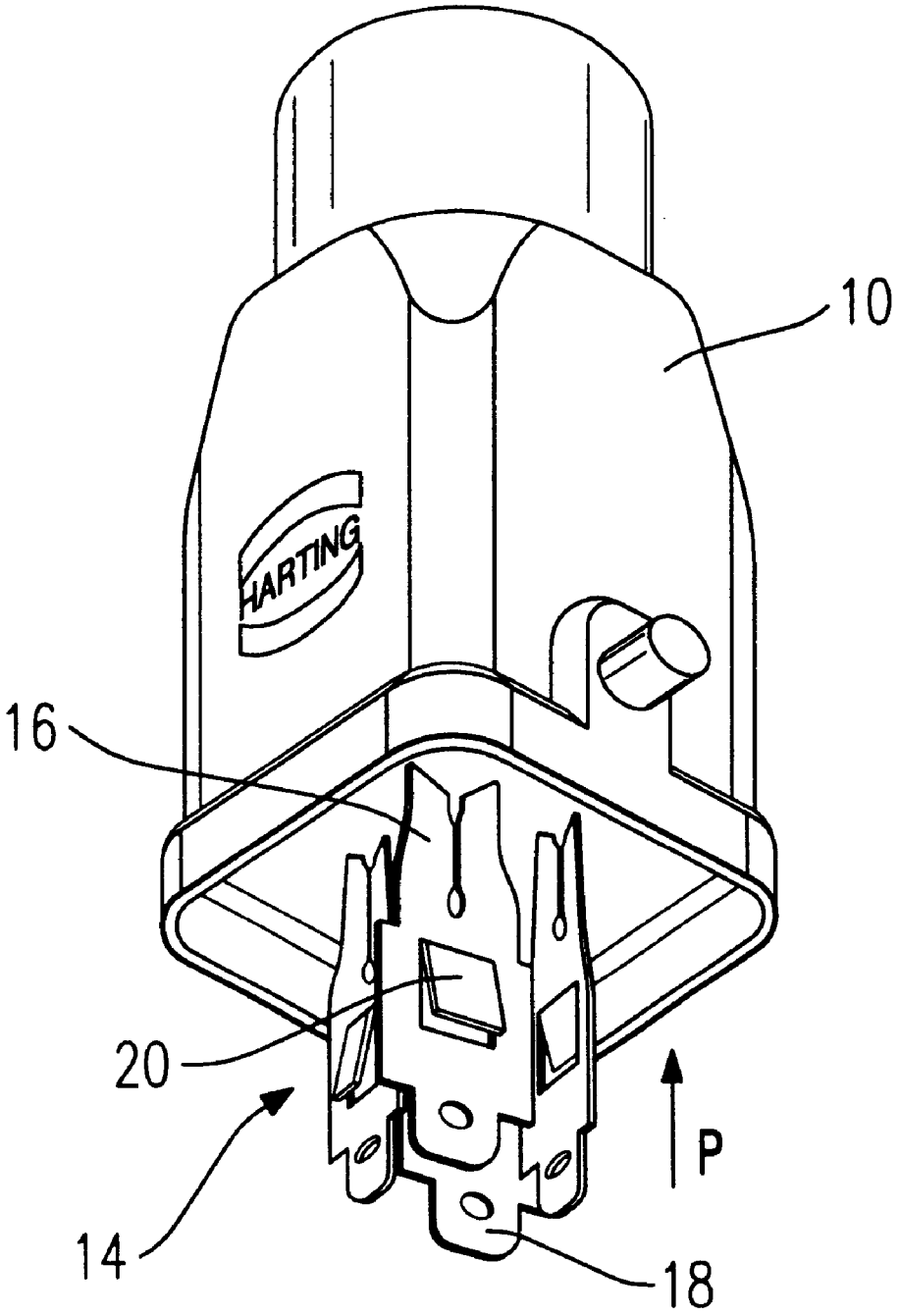
FIG. 2 shows in a perspective view the housing of a plug connector of FIG. 1, with connection contacts being arranged within the housing.

In FIGS. 1 to 4 there is shown a plug connector according to a first embodiment. It has a first insulating body 10 which in this embodiment forms at the same time the housing of the plug connector. The first insulating body has several receiving slots 12, into each of which a connection contact 14 is inserted. In this context, a connection contact is understood to be a contact which is provided for being connected with a conductor of a cable, for instance. In the embodiment shown, the connection contacts 14 are formed at their connection terminal as insulation piercing contacts 16 (see FIG. 2), into which the conductor of the cable to be connected can be pressed, so that the piercing contacts cut through the insulation of the conductor and the contacting automatically occurs. At the end facing away from the piercing contacts 16, the contacts are provided with a plug-in tab 18 each, the function of which will be explained below. Each connection contact is provided with a locking tab 20 between the piercing contact 16 and the plug-in tab 18, so that the connection contact undetachably latches in place when it is pushed into the receiving slot 12 in the direction of arrow P of FIG. 2.

The first insulating body 10 is designed such that a mount 22 is formed which surrounds the plug-in tabs 18 of the connection contacts 14. A second insulating body 24, provided with plug-in contacts 26 (see also FIG. 3), can be inserted into or arranged in the mount 22. Here, a plug-in contact is understood to be a contact which is provided for being brought into engagement with a contact of a complementary plug connector. This can be, for instance, a socket contact or a pin contact.

The second insulating body 24 is provided with several receiving holes 28 into which the plug-in contacts 26 are inserted such that they latch in place there. In the embodiment shown, each plug-in contact has a socket portion 30 into which a pin contact of a complementary plug connector can be inserted, as well as two elastic tabs 32 which lie opposite each other separated by a slot and are divided in two elastic segments each.

Figure 3:
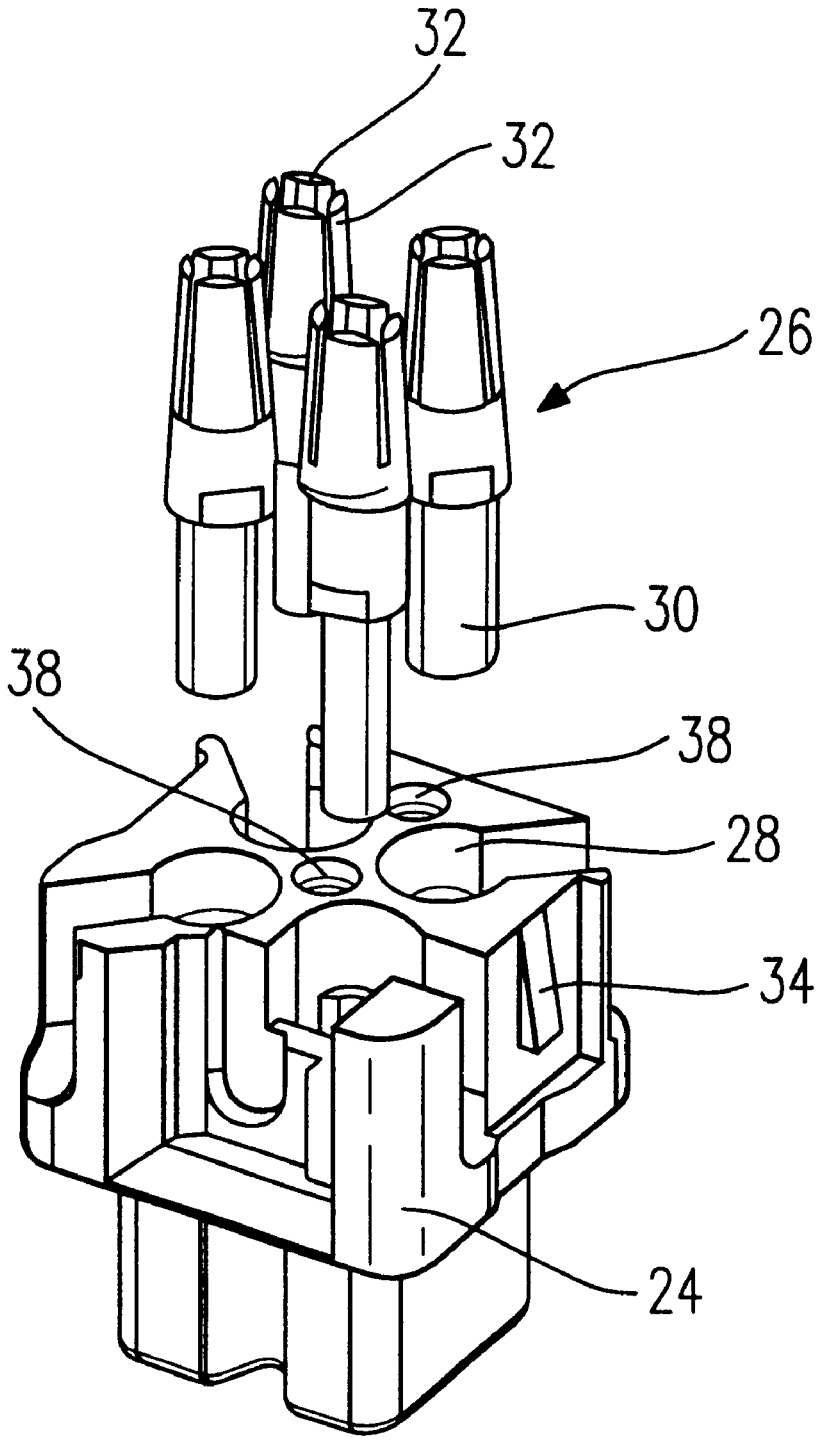
FIG. 3 shows in a perspective view an insulating body which is arranged within the plug connector of FIG. 1, having plug-in contacts which are arranged in the insulating body.
Figure 4:
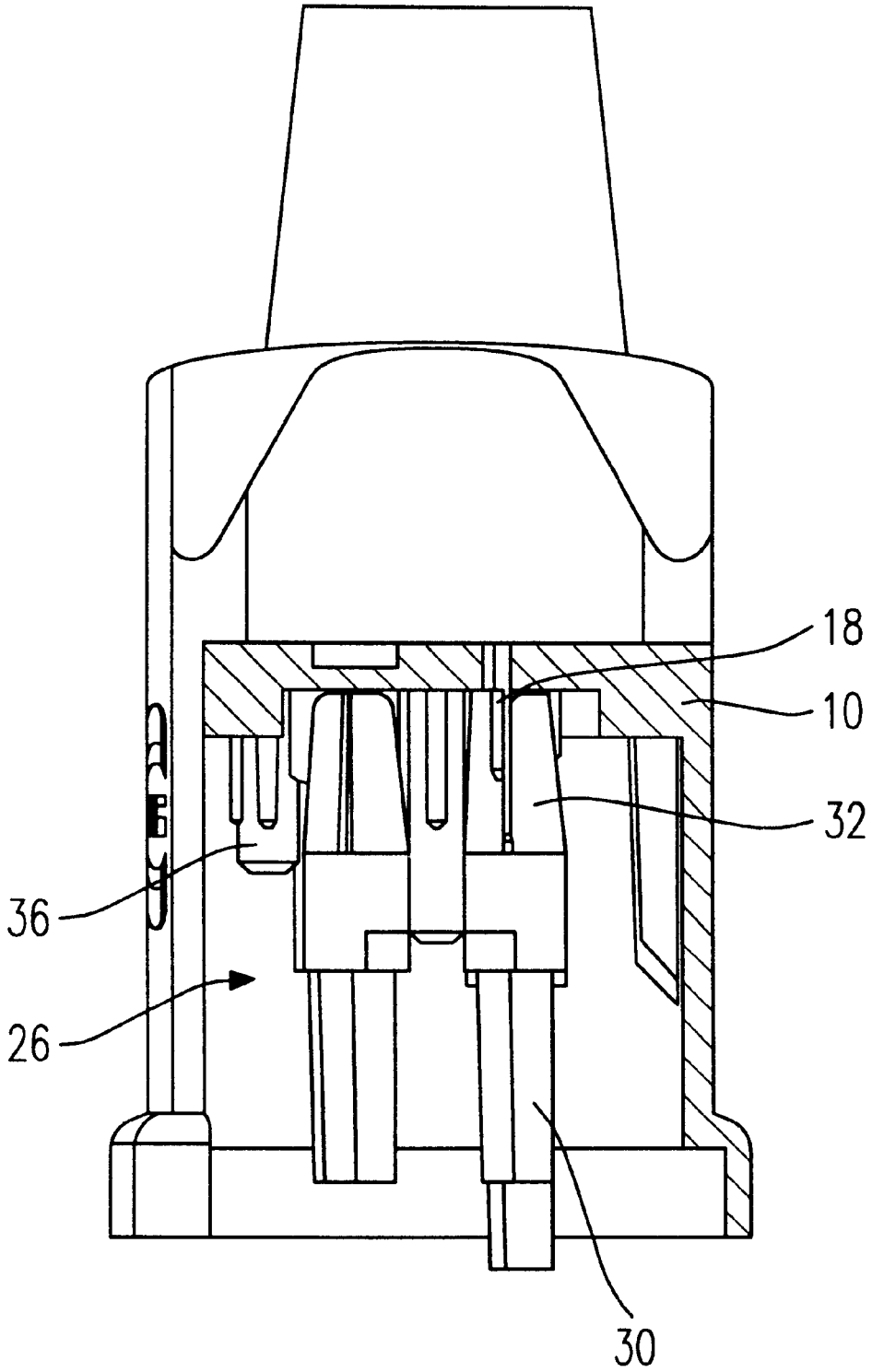
FIG. 4 shows the plug connector of FIG. 1 in a partially sectioned view, the insulating body not being illustrated.
Figure 5:
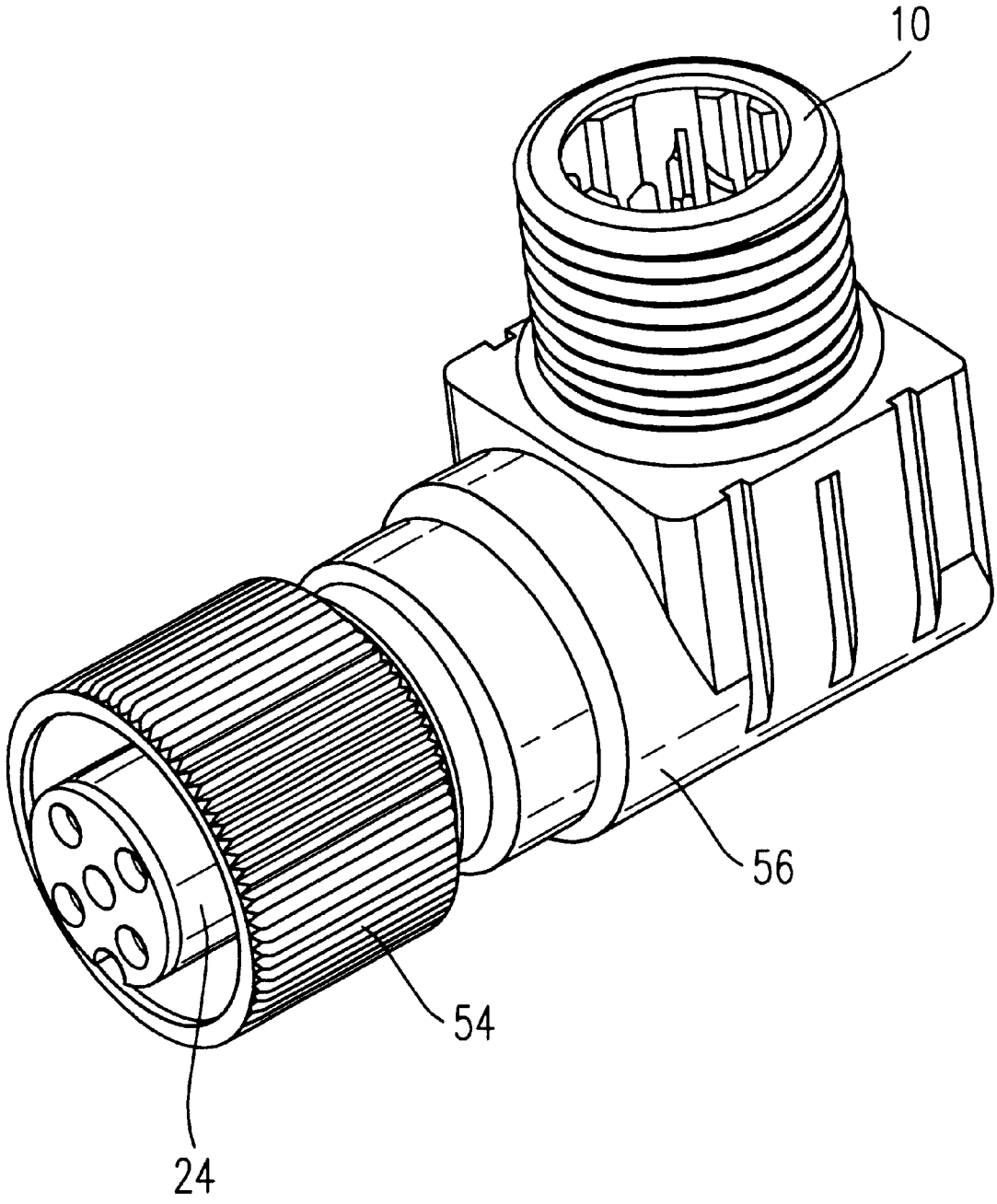
FIG. 5 shows a plug connector according to a second embodiment of the invention, in a perspective view.
Figure 6:
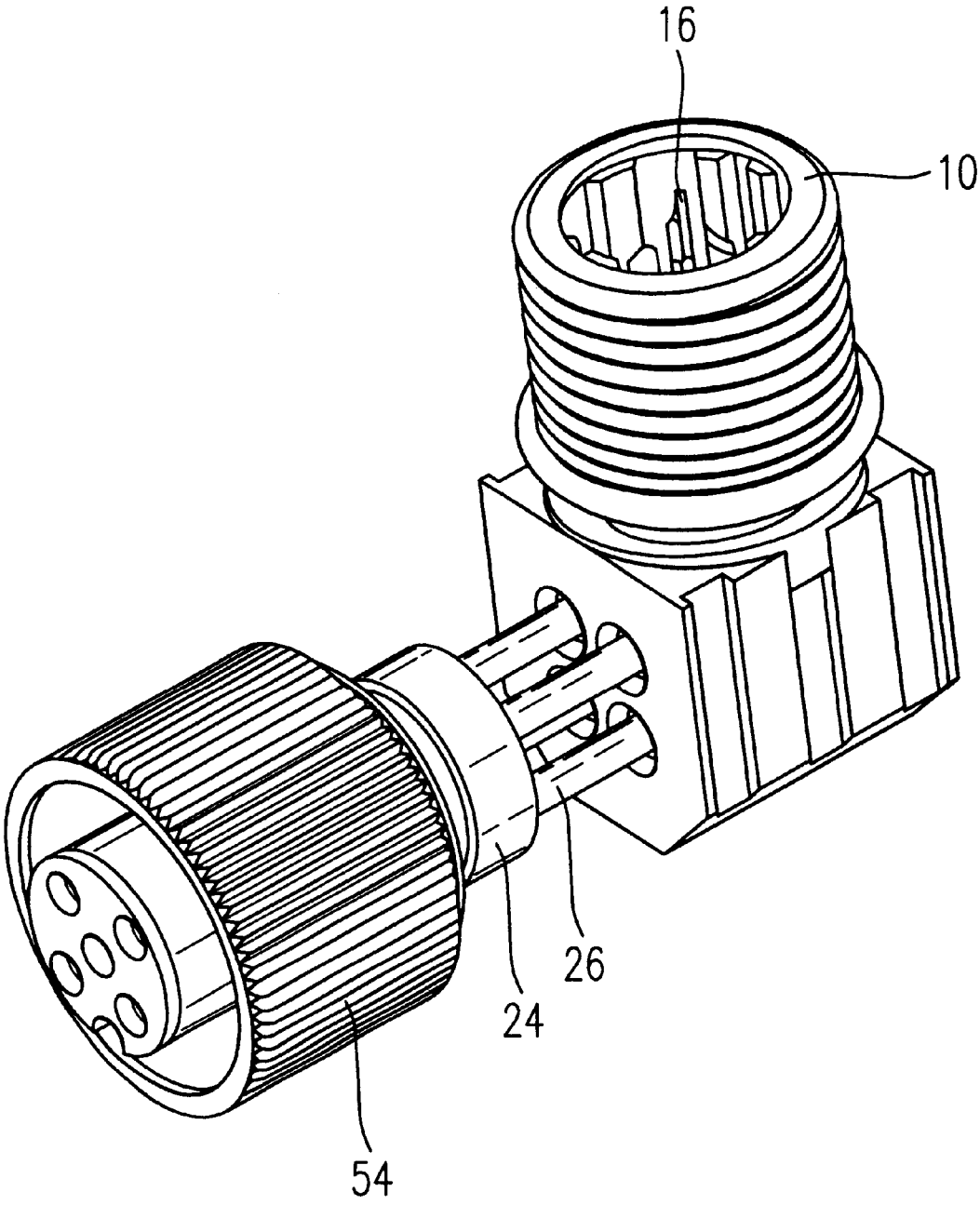
FIG. 6 shows in a perspective view the plug connector of FIG. 5 during mounting, prior to the housing having been made by injection molding.
Figure 7:
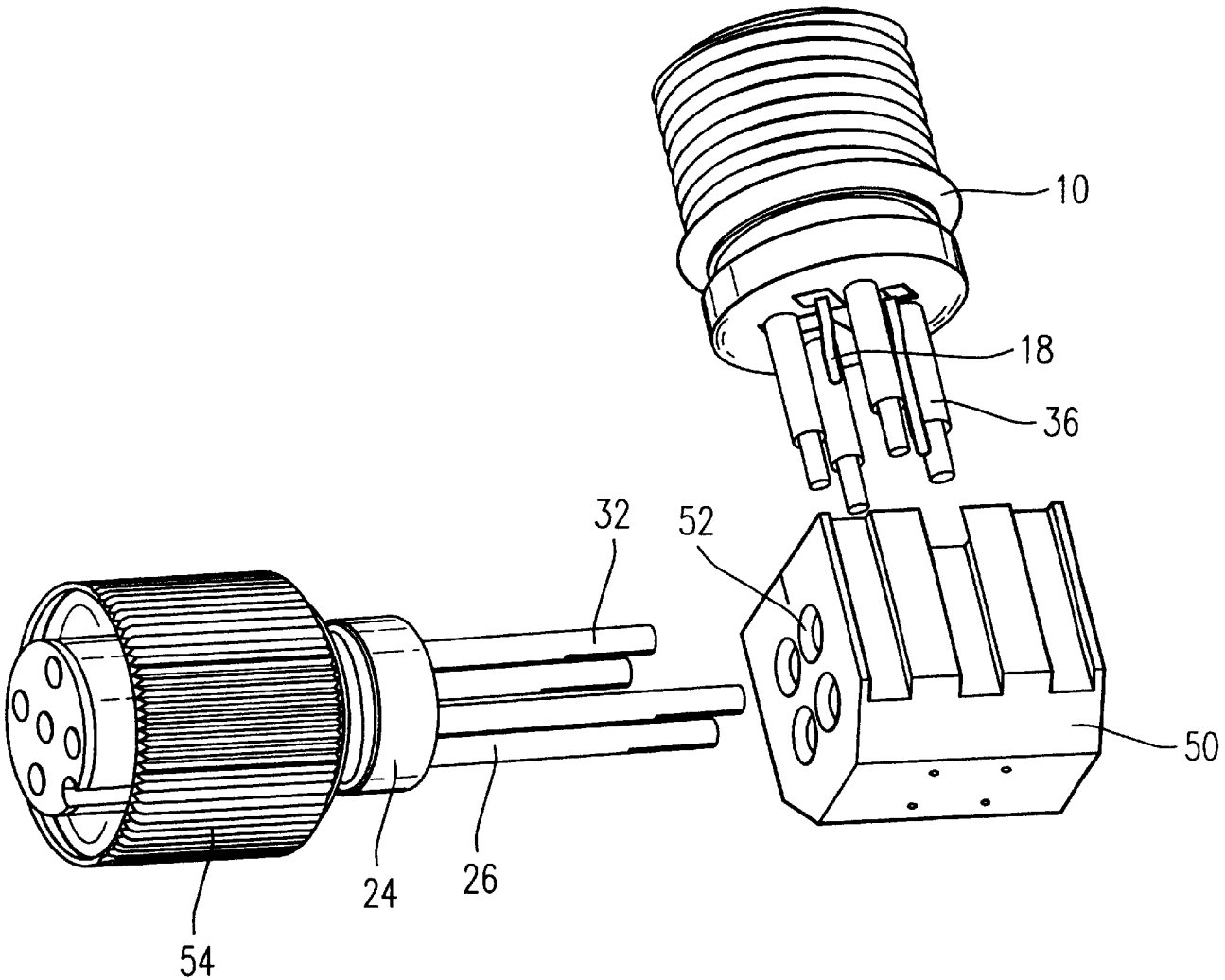
FIG. 7 shows in a perspective view the two insulating bodies and the adapter, which are used in the plug connector of FIG. 5.
Figure 8:
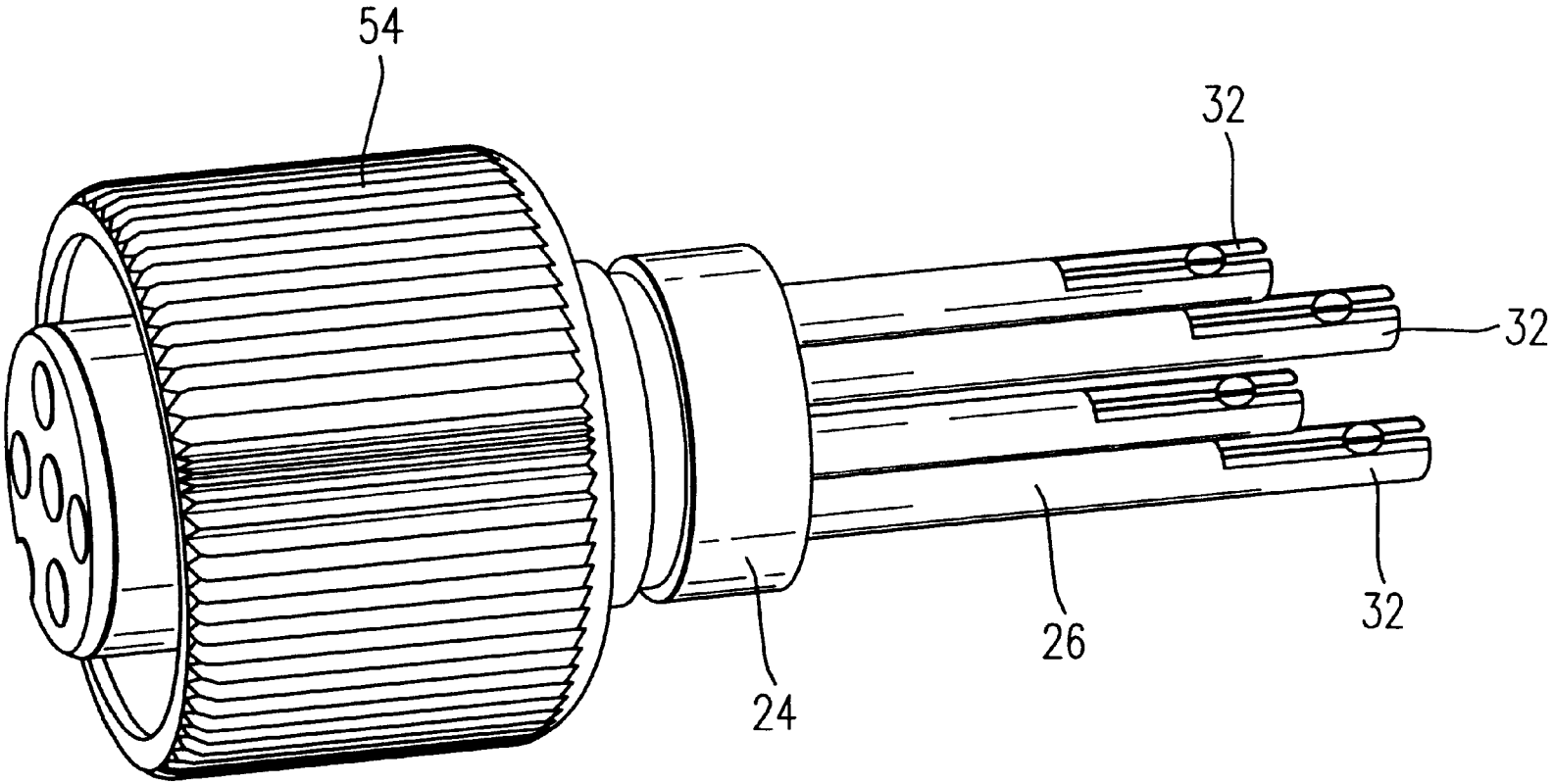
FIG. 8 shows in a perspective view one of the insulating bodies of FIG. 7, with the plug-in contacts inserted in it.
Figure 9:
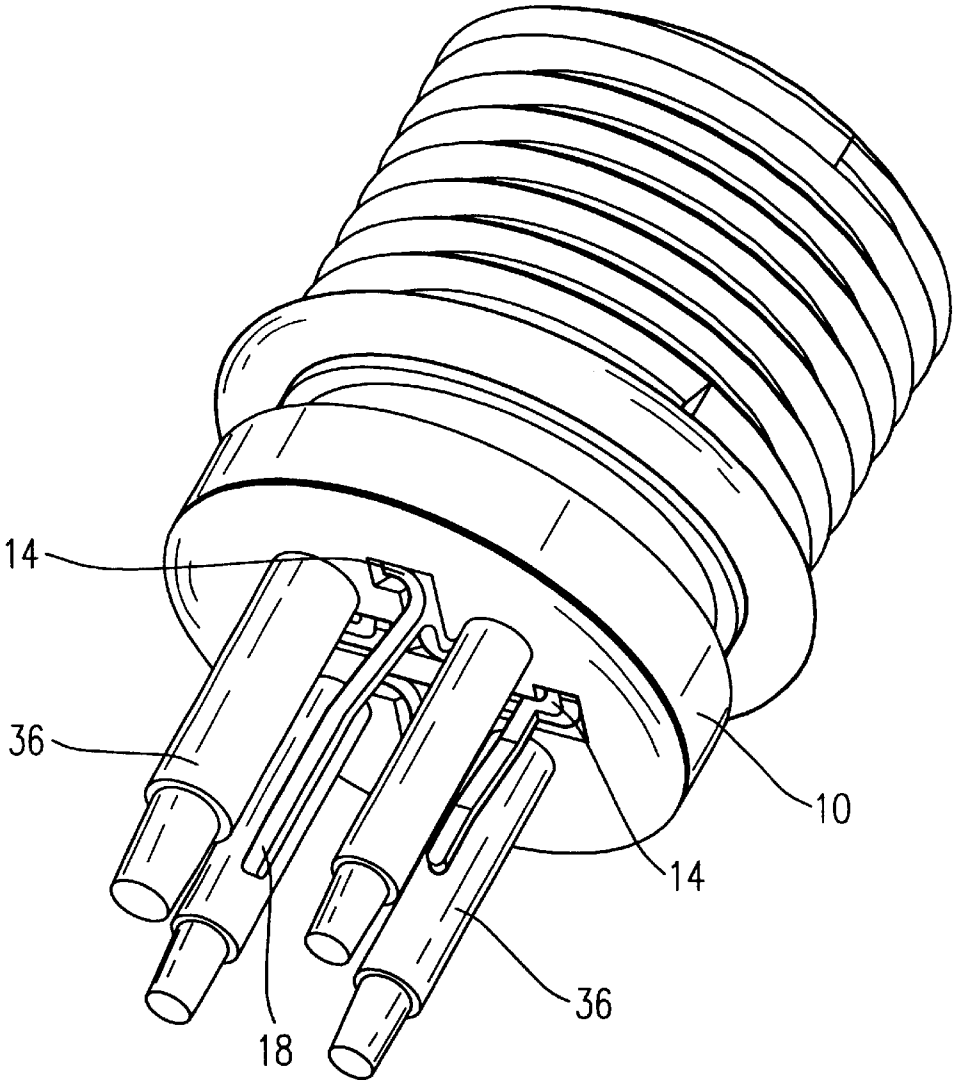
FIG. 9 shows in a perspective view the other of the insulating bodies of FIG. 7, with the connection contacts inserted in it.

Provided on the second insulating body 24 are several latching noses 34 of which only one is to be seen in FIG. 3. Provided on the first insulating body 10 are complementary formations on which the latching noses can latch in place. Several guiding pins 36 are also formed on the first insulating body 10, which can engage into complementary guiding openings 38 on the second insulating body 24.

The plug connector is mounted in the following way: First, the connection contacts 14 are pushed into the receiving slots 12 of the first insulating body and the plug-in contacts 26 are pushed into the receiving holes 28 of the second insulating body 24, so that they latch in place there. The second insulating body 24 is subsequently pushed into the first insulating body 10, the guiding pins 36 together with the guiding openings 38 ensuring the correct alignment of the two insulating bodies to each other, so that a defined coding is achieved. When the second insulating body 24 is pushed into the first insulating body 10, the elastic tabs 32 of the plug-in contacts 26 are pushed onto the plug-in tabs 18 of the connection contacts 14, so that an electrically conductive connection occurs between the connection contacts 14 and the plug-in contacts 26. When the second insulating body 24 has been completely pushed into the first insulating body 10, the latching noses 34 snap in place on the first insulating body 10, so that the two insulating bodies are firmly connected with each other. This state can be seen in FIG. 4; the elastic tabs 32 are completely pushed onto the plug-in tabs 18 of the connection contacts. The mounting of the plug connector is finished now.

Apart from the particularly simple mounting, which merely consists of several plug-in operations which on top of this take place in the same direction, the structure described makes possible a particularly variable production, because different insulating bodies having different contacts can be combined in the nature of a modular system.

As an alternative to securing the connection and the plug-in contacts by a latching action it can also be provided for that the contacts either are only loosely arranged in the receiving slots of the first insulating body and the receiving holes of the second insulating body, or are pushed in there with a press fit. The definite fixing is effected not until the second insulating body is inserted in the first insulating body.

In FIGS. 5 to 9 there is shown a plug connector according to a second embodiment. Like reference numerals are used for the components which are known from the first embodiment, and reference is made to the above explanations.

Unlike the first embodiment, the one insulating body is not inserted into the other in the second embodiment, but both insulating bodies are inserted into an adapter 50. The latter is provided with insertion openings 52 for the connection contacts and the plug-in contacts. In the embodiment shown, the adapter 50 is designed such that the plug-in and the connection contacts are not inserted into each other in longitudinal direction, as is the case in the first embodiment, but at a right angle to each other.

Also in this embodiment the first insulating body is provided with guiding pins 36, the complementary guiding openings now being provided on the adapter 50. Provided on the outer surface of the first insulating body 10 is a thread onto which a sleeve nut can be screwed later on.

The second insulating body 24 is provided with a sleeve nut 54 which is rotatably arranged on it. Later on, a complementary plug connector engaging into the plug-in contacts 26 can be locked by means of the sleeve nut.

The most substantial difference to the first embodiment is that a separate housing is provided in the second embodiment. This is formed here as an injection-molded housing 56 in which the first insulating body 10, the second insulating body 24 and the adapter 50 are inseparably embedded.

The plug connector described is mounted in the following way: First, the connection contacts 14 are arranged within the first insulating body 10 and the plug-in contacts 26 within the second insulating body 24. Next, the connection contacts and the plug-in contacts are pushed into the adapter 50, they forming an electrically conductive connection by means of their plug-in tabs 18 and elastic tabs 32. The insertion openings 52 and the guiding openings 38 in the adapter are dimensioned such that the two insulating bodies 10, 24 are retained in the adapter 50, assisted by the friction between the plug-in tabs 18 and the elastic tabs 32. In this way there is formed a preassembled unit, shown in FIG. 6, which can be handled for further mounting without any problems. Subsequently, the first and second insulating bodies as well as the adapter are embedded with plastics material by means of injection molding, so that the injection-molded housing 56 is formed.

Also in this embodiment different insulating bodies with different connection contacts and plug-in contacts can be combined with each other in a modular concept. The housing can be adapted in a flexible manner to the respective requirements.

Figure 10:
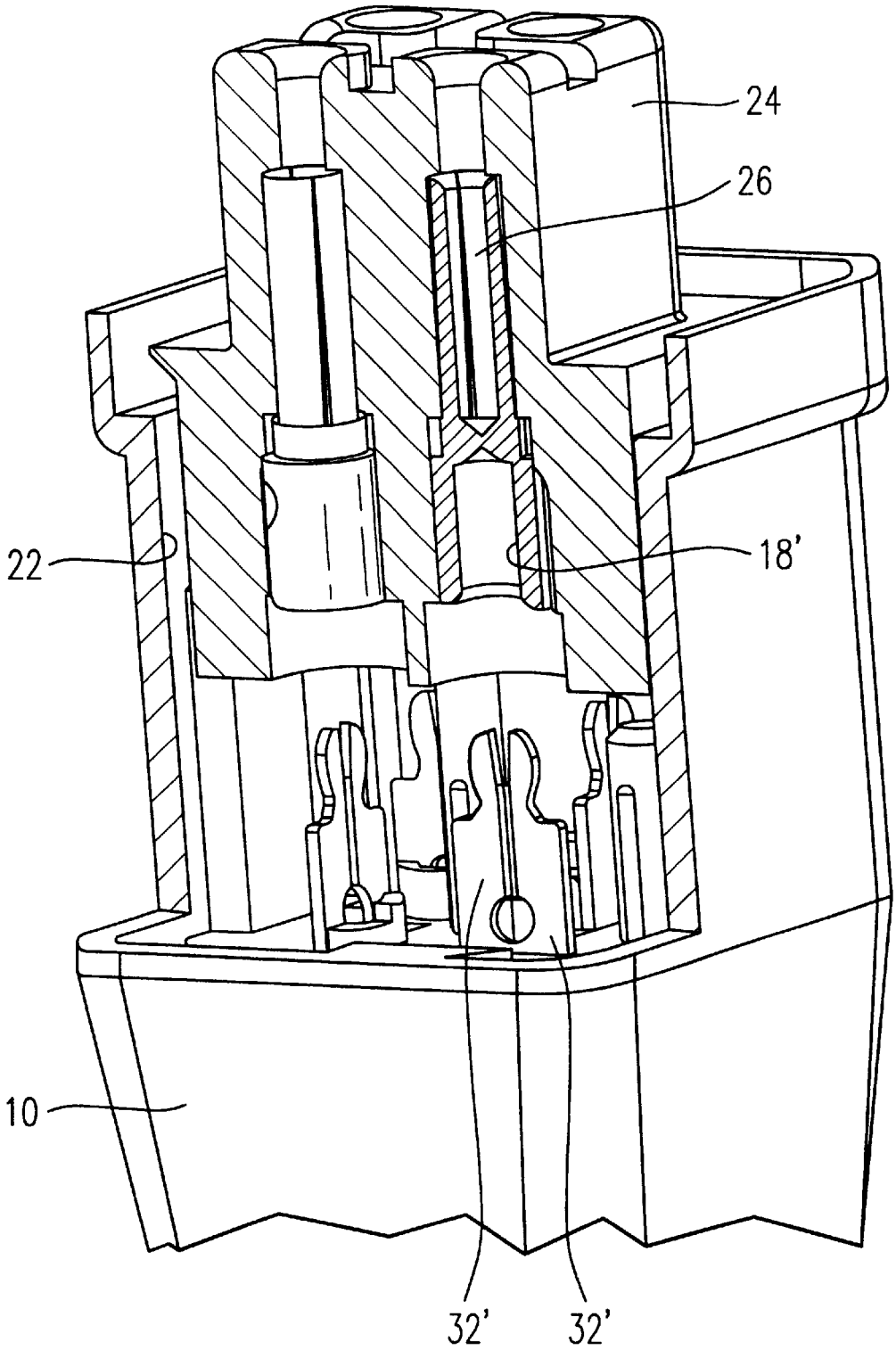
FIG. 10 shows in a perspective partially sectional and cut-away view a plug connector according to a third embodiment of the invention during mounting.
Figure 11:
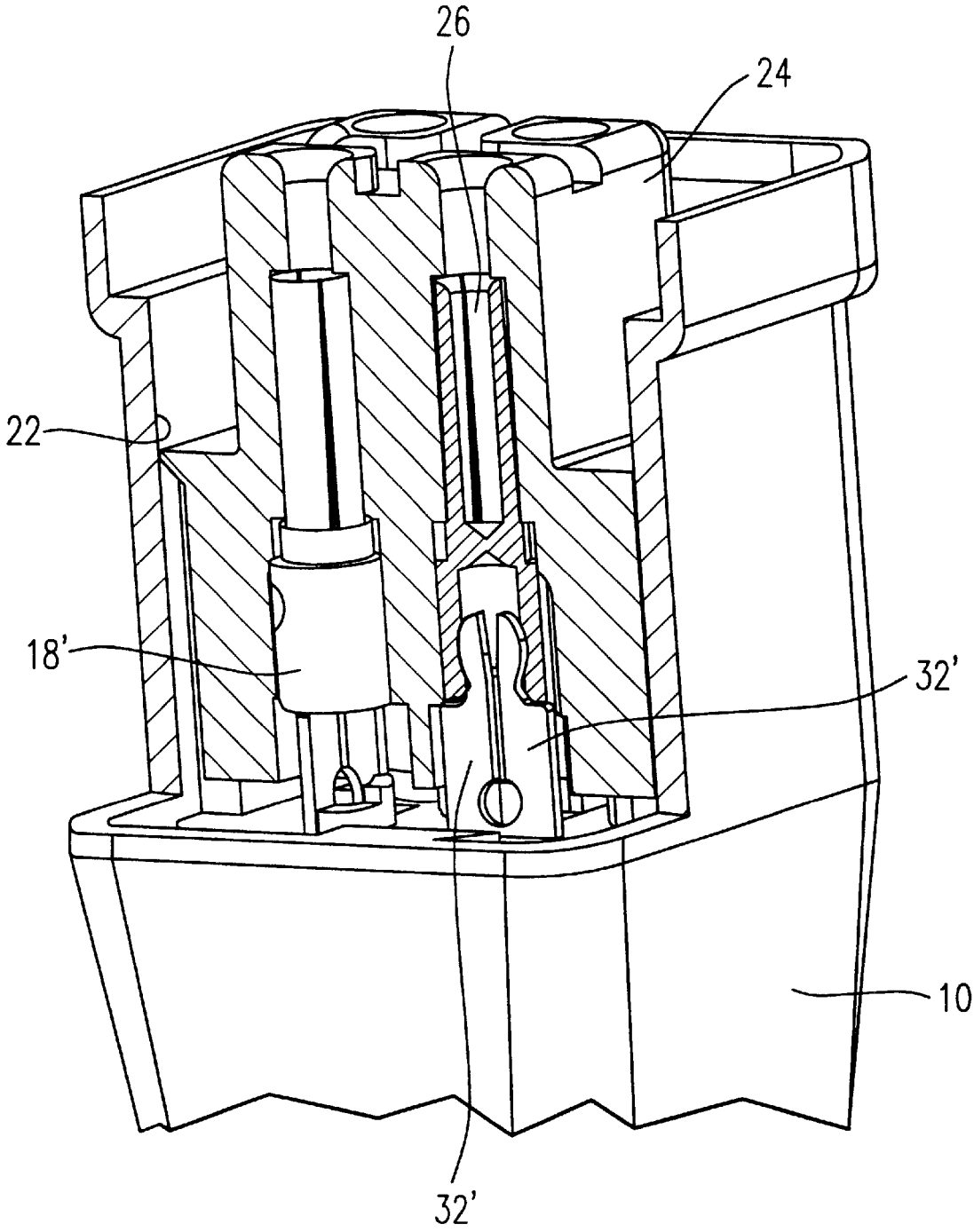
FIG. 11 shows the plug connector of FIG. 10 when mounted.

In FIGS. 10 and 11 there is shown a plug connector according to a third embodiment. With regard to the design of the two insulating bodies 10, 24, the third embodiment is similar to the first embodiment. The difference to the first embodiment lies in the design of the plug connection between the piercing contacts 16 and the plug-in contacts 26.

In the third embodiment, each piercing contact is provided with two neighboring elastic tabs 32', which together form a generally rectangular body portion and a rounded body portion. The slot separating the two elastic tabs 32' from each other terminates in a circular recess which on the one hand makes possible the desired elasticity of the elastic tabs 32' relative to each other and, on the other, avoids a notch effect at the end of the slot.

The plug-in contacts are provided with jack 18' having a circular cross-section, for receiving the head portion constituted by the two elastic tabs 32'.

When the second insulating body 24, provided with the plug-in contacts 26, is pushed into the recess 22 in the first insulating body, the rounded head portion of the elastic tabs 32' is pushed into the jack 18' of the corresponding plug-in contact 26. In so doing, the head portion and thereby also the body portion are elastically compressed, with the result of a safe contact-making between the piercing contacts and the plug-in contacts. Unlike the first embodiment, in which the plug-in tab of the plug-in contact has been inserted between the elastic tabs, the plug-in contact engages on the outside of the elastic tabs.

When the second insulating body 24 has been completely pushed into the mount 22 in the first insulating body (see FIG. 11), the end face of the jack 18' rests against the transition between the head portion and the body portion of the elastic tabs 32'.

What is claimed is:

1. A plug connector comprising a first insulating body, at least one connection contact which is arranged in said first insulating body and is provided for being connected with a conductor, a second insulating body and at least one plug-in contact which is arranged in said second insulating body and is provided for being connected with a complementary plug connector, said plug-in contact and said connection contact being connected with each other in an electrically conductive manner by a plug connection, said plug connection being formed by two elastic tabs provided on one of said contacts and cooperating with the other of said contacts, wherein said two insulating bodies are arranged in a separate housing, wherein said two insulating bodies are embedded by injection molding so as to be inseparably embedded, wherein said plug-in contact and said connection contact are inserted into each other at a right angle, wherein an adapter is provided, into which said plug-in contact and said connector contact are inserted.

2. The plug connector of claim 1, wherein said insulating body is provided with at least one guiding pin which ensures a correct alignment of said insulating body.

3. A method for mounting a plug connector by means of the following steps:

at least one connection contact is arranged in a first insulating body;

at least one plug-in contact is arranged in a second insulating body;

said plug-in contact and said connection contact are inserted into each other; and said insulating bodies are embedded in plastics by means of injection molding, so that a housing is formed in which said insulating bodies are firmly anchored whereinsaid plug-in contact and said connection contact are inserted into adapter.

4. A plug connector comprising a first insulating body, at least one connection contact which is arranged in said first insulating body and is provided for being connected with a conductor, a second insulating body and at least one plug-in contact which is arranged in said second insulating body and is provided for being connected with a complementary plug connector, said plug-in contact and said connection contact being connected with each other in an electrically conductive manner by a plug connection, said plug connection being formed by two elastic tabs provided on one of said contacts and cooperating with the other of said contacts, wherein said two insulating bodies are arranged in a separate housing, wherein said two insulating bodies are embedded by injection molding so as to be inseparably embedded, wherein said plug-in contact and said connection contact are inserted into each other at a right angle.

5. A plug connector comprising a first insulating body, at least one connection contact which is arranged in said first insulating body and is provided for being connected with a conductor, a second insulating body and at least one plug-in contact which is arranged in said second insulating body and is provided for being connected with a complementary plug connector, said plug-in contact and said connection contact being connected with each other in an electrically conductive manner by a plug connection, said plug connection being formed by two elastic tabs provided on one of said contacts and cooperating with the other of said contacts, wherein said two insulating bodies are arranged in a separate housing, wherein said two insulating bodies are embedded by injection molding so as to be inseparably embedded, wherein an adapter is provided, into which said plug-in contact and said connection contact are inserted.

6. The plug connector of claim 1, wherein a plurality of latching noses are formed on one of said first and second insulating bodies and complementary formations for receiving said noses are formed on the other of said first and second insulating bodies so as to inseparably connect said first and second insulating bodies with each other.

7. A plug connector comprising a first insulating body, at least one connection contact which is arranged in said first insulating body and is provided for being connected with a conductor, a second insulating body and at least one plug-in contact which is arranged in said second insulating body and is provided for being connected with a complementary plug connector, said plug-in contact and said connection contact being connected with each other in an electrically conductive manner by a plug connection, said plug connection being formed by two elastic tabs provided on one of said contacts and cooperating with the other of said contacts, said plug connection comprising a jack between said plug-in contact and said connection contact, said jack being formed on one of said two contacts and stuck on said two elastic tabs, said elastic tabs being separated by a slot and together forming a generally rectangular body portion and a rounded head portion, said head portion engaging into said jack, an end face of said jack resting against a transition between said head portion and said body portion.

8. The plug connector of claim 7, wherein said plug-in contact and said connection contact are inserted into each other in longitudinal direction.

9. The plug connector of claim 7, wherein one of said insulating bodies is a housing of said plug connector and the other of said insulating bodies is an insert piece which is received in said housing.

10. The plug connector of claim 9, wherein said insert piece is latched into place in said housing.

* * * * *

UNITED STATES PATENT AND TRADEMARK OFFICE

CERTIFICATE OF CORRECTION

PATENT NO. : 6,688,922 B2
DATED : February 10, 2004
INVENTOR(S) : Stephan Schreier et al.

It is certified that error appears in the above-identified patent and that said Letters Patent is hereby corrected as shown below:

Title page,
Item [30], Foreign Application Priority Data, please add the following:
-- May 8, 2002 [DE] Fed. Rep. of Germany...100 22 374.5 --.

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,688,922 B2
DATED : February 10, 2004
INVENTOR(S) : Stephan Schreier et al.

It is certified that error appears in the above-identified patent and that said Letters Patent is hereby corrected as shown below:

Title page,
Item [30], Foreign Application Priority Data, please add the following:
-- May 8, 2000 [DE] Fed. Rep. of Germany...100 22 374.5 --.

This certificate supersedes Certificate of Correction issued June 22, 2004.

Signed and Sealed this

Twenty-fourth Day of August, 2004

JON W. DUDAS
*Director of the United States Patent and Trademark Office*